US008590239B2

(12) United States Patent
Bathon

(10) Patent No.: US 8,590,239 B2
(45) Date of Patent: Nov. 26, 2013

(54) CONSTRUCTION MADE OF INDIVIDUAL COMPONENTS

(76) Inventor: Tobias Bathon, Glattbach (DE)

( * ) Notice: Subject to any disclaimer, the term of this patent is extended or adjusted under 35 U.S.C. 154(b) by 426 days.

(21) Appl. No.: 12/160,622

(22) PCT Filed: Jan. 12, 2007

(86) PCT No.: PCT/DE2007/000062

§ 371 (c)(1),
(2), (4) Date: May 14, 2010

(87) PCT Pub. No.: WO2007/079739

PCT Pub. Date: Jul. 19, 2007

(65) Prior Publication Data

US 2010/0293867 A1 Nov. 25, 2010

(30) Foreign Application Priority Data

Jan. 13, 2006 (DE) ..... 20 2006 000 593 U
Aug. 7, 2006 (EP) ..... 06016424

(51) Int. Cl.
*E04B 1/18* (2006.01)
*E04B 1/36* (2006.01)
*E04B 5/12* (2006.01)

(52) U.S. Cl.
USPC ..... 52/334; 52/167.4; 52/252; 52/309.12; 52/328; 52/841; 52/745.05

(58) Field of Classification Search
USPC ..... 52/309.12, 309.1, 309.17, 327, 328, 52/331, 333, 334, 414, 250, 252, 841, 52/167.4–167.6, 745.05
See application file for complete search history.

(56) References Cited

U.S. PATENT DOCUMENTS

| | | | | | |
|---|---|---|---|---|---|
| 872,726 | A | * | 12/1907 | Grady | 52/602 |
| 983,699 | A | * | 2/1911 | Ferguson | 52/414 |
| 1,183,594 | A | * | 5/1916 | Robinson | 264/32 |
| 1,666,061 | A | * | 4/1928 | Foster | 52/335 |
| 1,781,517 | A | * | 11/1930 | McKeown | 52/573.1 |
| 2,113,875 | A | * | 4/1938 | Clark | 52/258 |
| 2,211,667 | A | * | 8/1940 | Moesly | 52/370 |
| 3,105,252 | A | * | 10/1963 | Milk | 14/73.5 |
| 3,604,177 | A | * | 9/1971 | Clyne et al. | 52/283 |
| 5,125,200 | A | * | 6/1992 | Natterer | 52/223.8 |
| 5,561,957 | A | * | 10/1996 | Gauthier | 52/334 |
| 5,634,308 | A | * | 6/1997 | Doolan | 52/334 |

(Continued)

FOREIGN PATENT DOCUMENTS

| | | |
|---|---|---|
| AT | 005 773 | 11/2002 |
| CH | 687 213 | 11/2002 |

(Continued)

*Primary Examiner* — Adriana Figueroa
(74) *Attorney, Agent, or Firm* — Da Vinci Partners LLC; John Moetteli

(57) ABSTRACT

The invention relates to a construction made of individual components which consist at least partially of wood-concrete composite elements (100) composed by at least one wood component (110) with a wood cross section and a concrete component (101) with a concrete cross section. The wood-concrete composite elements are at least partially prefabricated and then brought together at the factory or later at the construction site. The individual components are connected and/or assembled with the other components by a non-positive and/or positive and/or material connection, partially by transmitting force only via the wood cross section or partially only by transmitting force via the concrete cross section or partially by the wood cross section and the concrete cross section.

20 Claims, 8 Drawing Sheets

(56) References Cited

U.S. PATENT DOCUMENTS

| | | | | |
|---|---|---|---|---|
| 5,660,492 | A | 8/1997 | Bathon | |
| 5,809,722 | A * | 9/1998 | Bertsche | 52/334 |
| 6,305,135 | B1 * | 10/2001 | Inaba | 52/309.12 |
| 7,281,357 | B2 * | 10/2007 | Femminella | 52/334 |
| 2004/0074183 | A1 * | 4/2004 | Schneider et al. | 52/334 |
| 2005/0086906 | A1 | 4/2005 | Bathon et al. | |

FOREIGN PATENT DOCUMENTS

| | | | | |
|---|---|---|---|---|
| DE | 44 06 433 | | 6/1995 | |
| DE | 44 45 108 | | 6/1996 | |
| DE | 198 05 088 | | 8/1999 | |
| DE | 298 03 323 | | 8/1999 | |
| DE | 198 08 208 | | 9/1999 | |
| DE | 198 18 525 | | 11/1999 | |
| DE | 201 19 279 | | 4/2002 | |
| DE | 202 10 714 | | 1/2003 | |
| EP | 0 433 224 | | 6/1991 | |
| EP | 0 664 326 | | 7/1995 | |
| EP | 0 826 841 | | 3/1998 | |
| EP | 0 952 271 | | 10/1999 | |
| EP | 1 528 171 | | 5/2005 | |
| FR | 2578276 | A1 * | 9/1986 | B28B 19/00 |
| WO | WO 94/11589 | | 5/1994 | |

* cited by examiner

CONSTRUCTION MADE OF INDIVIDUAL COMPONENTS

CROSS REFERENCE TO RELATED APPLICATIONS

The present application is the US National Stage of PCT Patent Application No. PCT/DE2007/000062, which claims benefit under 35 U.S.C. §119(a) of German patent application no. 202006000593.5 filed Jan. 13, 2006, and European patent application no 06016424.1 filed Aug. 7, 2006, the content of which is incorporated herein by reference thereto and relied upon.

BACKGROUND OF THE INVENTION

The invention relates to constructions and/or buildings wherein the individual components such as for example walls, ceilings, floors, pillars, girders, slabs, plates, foundations, main beams and/or roofs are at least partially composed of prefabricated wood-concrete composite elements, and methods for the manufacture of such constructions.

It is known to manufacture constructions and/or buildings at least partially in prefabricated construction in wood construction, in steel construction, in brick construction and in concrete construction. It is also known to manufacture portions of buildings in mixed construction, e.g. as reinforced concrete and/or as steel sandwich. Due to the prefabricated construction the walls and ceilings of such a building can be prefabricated to a large extent so that the slab-like elements need only be assembled on the construction site.

Methods are also known where semi-finished parts, e.g. made of concrete (keyword: filigree ceiling) are brought on the construction site and are completed only in a second step by a corresponding topping.

It is also known to mix materials in constructions and/or buildings. Thus, one can find all variations of buildings where masonry walls, reinforced concrete ceilings and/or roof framework of wood have been made.

From AT 005 773 U1 it is known to combine partial cross sections out of wood as well concrete as a composite component.

From U.S. Pat. No. 5,256,200 it is known to combine wood and concrete by a non-positive connection.

From DE 198 05 088 A1 it is known to manufacture wall and ceiling elements out of concrete, plastics, metal and paper board in a material mix such that they are suitable for do-it-yourself construction.

From DE 202 10 714 U1 it is known to manufacture wood-concrete composite elements with integrated climatic elements.

From EP 0 826 841 A1 it is known to manufacture a module house from prefabricated steel plates such that a permanent weather protection exists.

From DE 298 03 323 U1 it is known to manufacture wooden houses easy to assemble.

Disadvantages of wooden construction in buildings are the fire load as well as the insufficient thermal mass of wood resulting in a poor heat protection in summer.

Disadvantages of masonry construction are high labor costs in the manufacture of buildings as well as insufficient heat insulation of these building systems. In that case valuable energy costs get lost for the user every year.

Disadvantages of steel construction are poor heat insulation properties of steel and the design solution approaches to avoid cold bridges necessary as a result.

Due to the comprehensive demands on a construction/building regarding stability, comfort, sound insulation, heat insulation, waterproofing, fire protection as well as short building times, conventional constructions meet limits. In particular due to the high demands as a result of the desire to save energy in connection with increasing challenges of incidents of high burden such as for example earthquakes and tornadoes there is a desire for alternative constructions/buildings meeting these challenges a world-wide basis.

SUMMARY OF THE INVENTION

It is an aim of the invention to create a construction and/or building, which meets the above mentioned tasks, by at least partial use of at least partially prefabricated wood-concrete composite elements as walls, ceilings, floors, pillars, girders, slabs, plates, foundations, main beams and/or roofs etc., if necessary in connection with further insulating and/or cladding materials.

This task is solved by the fact that for the constructions the individual components at least partially are composed of wood-concrete composite elements which, if necessary, have corresponding further insulating and/or cladding materials.

DETAILED DESCRIPTION OF THE PREFERRED EMBODIMENT(S)

Figure 1:
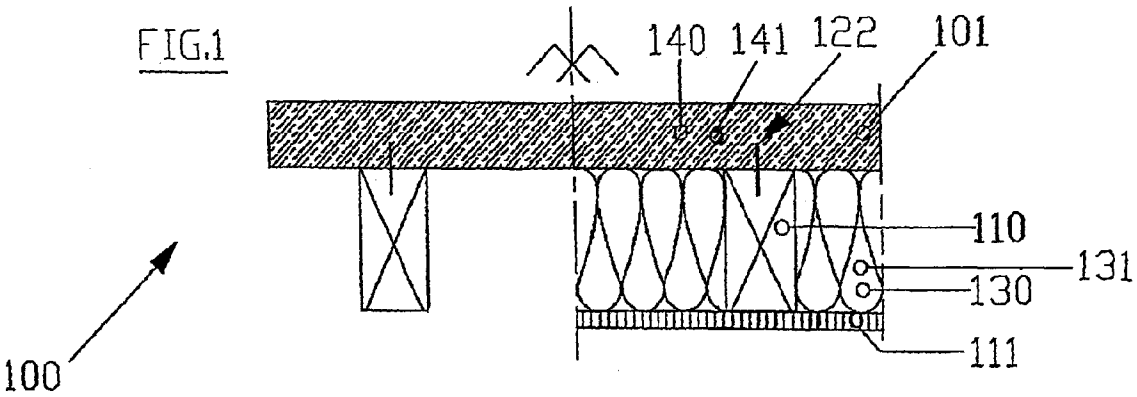
FIG. 1 is a cross-sectional view of an embodiment of the invention.

Surprisingly it has turned out that that the wood-concrete composite elements offer an efficient design for walls, ceilings, floors, pillars, girders, slabs, plates, foundations, main beams and/or roofs meeting the requirements. With respect to the carrying capacity the materials on the basis of the compound effect divide the forces and/or loads among themselves according to their stiffness ratios. Moreover, the material mix depending on its arrangement provides clear advantages in sound insulation, heat insulation, waterproofing and fire protection. Due to the possibility of prefabrication, moreover components are created which can easily be assembled on the construction site.

Building Envelope

An inventive design of the building envelope (roof, roof ceiling, wall and/or floor elements) consists of a thin concrete slab upon which wood cross sections are arranged in compound on the outside (unilaterally). In such embodiment the steel reinforcement integrated into the concrete assumes the bending tensile forces whereas the bending compressive forces are attributed to the wood cross section. It has surprisingly turned out that considerable improvements are achieved in building physics and statics by this arrangement. First of all it has to be stated that the internal concrete slab serves as a heat accumulator, vapor barrier, installation level, fire barrier and/or plate formation. Moreover, a fair-faced concrete quality offers a finished surface, which, if required, can also be covered by a wallpaper for example. At the same time, the spaces of the external wood cross sections serve as insulation, installation and/or force coupling level. For the roof elements this means for example also that they can be covered conventionally with tiles and thus optically do not differ from conventional roofs.

For the wall elements this means that the existing wood cross section can be formed externally in a conventional way by means of a wooden facade and/or plaster facade.

Another inventive embodiment of the building envelope (roof, roof ceiling, wall and/or floor elements) is composed of a thin concrete slab upon the internal surface of which wood cross sections are arranged (unilaterally) in compound. In this embodiment the concrete assumes the bending compressive forces in case of external pressure whereas the bending tensile forces are allocated to the wood cross section. It has surprisingly turned out that due to this arrangement likewise considerable improvements are achieved in building physics and statics. First of all it has to be stated that the external concrete slab serves as a heat accumulator, vapor barrier (for tropical climates), installation level and/or fire barrier. But surprisingly this embodiment of the invention provides also a very stiff and stable "skin" withstanding all extreme loads such as for example earthquakes and/or tornadoes (hurricanes, typhoons). At the same time the spaces of the internal wood cross sections serve as an insulating level as well as a construction surface upon which other cladding materials such as for example planking, gypsum plaster boards, chip boards, wallpapers, plasters can be applied.

Another inventive embodiment of the building envelope is to combine the components for especially required customer demands in their arrangement such that the concrete slabs are partly arranged inside and partly outside. Thus, this would be a combination of the two paragraphs mentioned above.

As other inventive embodiments of the roof, ceiling, wall and/or floor elements those versions have to be considered where a thin concrete slab in compound (i.e. by a non-positive connection) is provided with at least one wood cross section from both sides (i.e. from the top and from the bottom and/or externally and internally). Thus, at least in one of the two levels between the wood cross sections (i.e. if necessary, of course also on both sides), insulations, installations, connection couplings and/or moisture barriers can be inserted. Due to the compound effect on both sides, these inventive embodiments provide very stable and good bearing components with integrated heat insulation properties and force coupling mechanisms.

As other inventive embodiments of the roof, ceiling, wall and/or floor elements those versions have to be considered where two adjacent thin concrete slabs in compound (i.e. by a non-positive connection) are provided with at least one intermediate wood cross section. Thus, in the wood cross section level insulations, installations, connection couplings and/or moisture barriers can be inserted. Due to the compound effect on both sides, these inventive embodiments provide very stable and good bearing components with integrated heat insulation properties.

Surprisingly it has turned out that the constructions/buildings can be manufactured very cost-effectively in prefabricated wood-concrete composite elements. On the one hand the efficient material usage of wood and concrete has to be considered for this. In that case, the steel portion in conventional reinforced concrete construction is replaced by wood. Moreover, this construction permits considerable weight reduction compared with conventional masonry and/or concrete buildings. This weight reduction results in cost savings for the building components themselves as well as the foundation. Moreover, the transport and erection cost (e.g. crane post) are reduced as a result as well.

The inventive building can be manufactured by different methods. A preferred method is to manufacture the wood-concrete composite elements as prefabricated components in the factory in order to connect them to each other and with other components (e.g. foundations) later on the construction site as prefabricated parts.

Another preferred method is to manufacture the wood cross sections and the concrete cross sections each as finished parts in order to connect them already in the factory and/or only later on the construction site in a thrust-proof manner into a wood-concrete composite system.

Another preferred method is to manufacture the wood cross sections and the concrete cross sections in compound at least as a semi-finished product in order to complete them already in the factory and/or only later on the construction site with corresponding cast-in-place concrete.

Materials

The concrete cross sections of the inventive wood-concrete composite components are for example manufactured out of individual elements in the form of a girder, a pillar, an I-binder, a truss girder, a slab or a plate or any combination of the above mentioned individual elements in the form of composite cross-sectional shapes such as for example TT-beams, I-beams, T-beams, box beams, web plates, π-plates. The concrete cross section can be manufactured as normal concrete, aerated concrete, lightweight concrete (also with non-mineral aggregates such as for example plastics, styrofoam, wood), high performance concrete, prestressed concrete, composite concrete, floor concrete, lightweight concrete, porous concrete and/or asphaltic concrete with corresponding reinforcing bars, mats and/or fibers out of metal and/or plastics as cast-in-place concrete and/or finished part and/or semi-finished part. The thickness of the concrete cross section varies between 40 mm min. to 500 mm. For example, in a building application especially advantageously thicknesses of a concrete slab and/or plate of 70 to 160 mm exist depending on whether it is a wall, roof or ceiling component whereas the application of the inventive wood-concrete composite construction in bridge construction and/or parking garage construction requires partial concrete thickness which might also exceed far beyond 160 mm.

The wood cross sections of the inventive wood-concrete composite components are by example manufactured from individual elements in the form of a girder, a plank, a board, a squared timber, an I-beam, a truss, a truss girder, a triangular girder, a slab or a boarding and/or any comb nation of the above mentioned individual elements in the form of composite cross sectional shapes such as for example truss girders, triangular girders, I-beams, T-beams, box beams, web plates.

In this connection the wooden components are made of waxed solid wood, wood materials and/or wooden composite materials. In order to make clear the plurality of the resulting alternatives of wood usage to some extent, a few are mentioned as follows: solid wood, coniferous wood, hardwood, gluelam, store timber, laminated wood, veneer laminated wood, strip veneer wood, chip wood, duo/trio girders, cement-bound chip boards, chip boards, multilayer boards, OSBs, plastic-wooden composite building slabs, cross-glued board plates, crosswise glued board layers etc. The entire cross sectional variety for bar cross sections as from 20/20 mm and for slab thicknesses as from 6 mm is imaginable here.

Connection of the Wood-Concrete Composite Components

The connection of the wood-concrete-composite components can be made via wood to wood, wood to concrete and/or concrete to concrete. As a connection means positive geometrical connection, glueing and/or mechanical connection means are imaginable which are governed by the corresponding standards such as for example DIN 1052, DIN 18800, DIN 1045 and/or the relevant technical literature as State of the Art. In addition, reference is made to the drawings/figures below showing corresponding further inventive embodiments of this diversity of types. Surprisingly it has turned out that some connection means are able to provide as formed metal parts the function of plate formation, anchorage, element coupling, crane attachment and/or corner screwing by the inventive selection of form. For an efficient transmission of force onto the concrete components corresponding connection reinforcements in the concrete cross sections are necessary here.

Connection of the Wood and Concrete Cross Sections

The compound or composite effect of the wood and concrete cross sections can take place via a plurality of known connection means. These include the method of positive geometrical connection (notch, journal, offset, indenting, recess), glued joint (wood-concrete glueing, glued-in and/or glued-on formed parts out of steel and/or plastics) and mechanical connection means (screws, nails, studs, clamps, nail plates, any formed steel parts according to standard and/or State of the Art). But the alternative of the glued-in formed metal parts has proven to be the preferred type of connection, since an efficient and powerful compound effect is achieved by it. Further information on this can be taken from the General Building Inspection Authorization of DIBT [German Institute of Structural Engineering] with authorization number Z-9.1-557.

Figure 2:
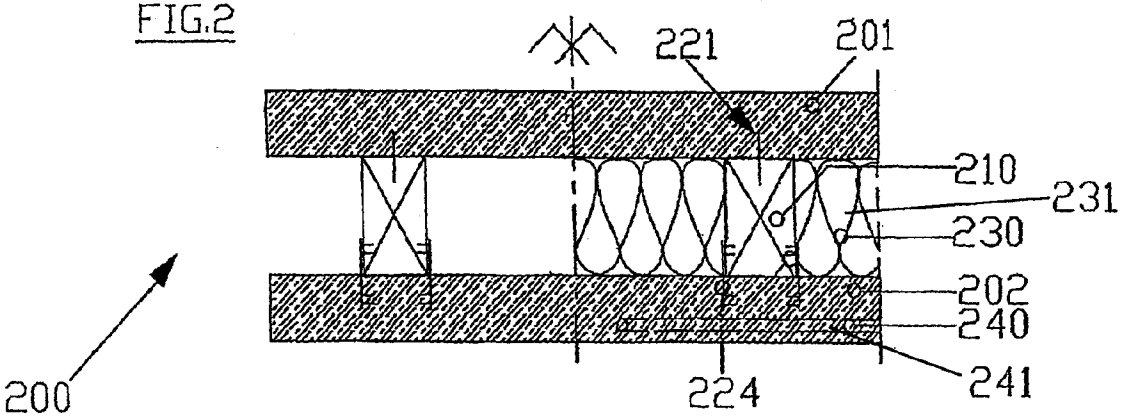
FIG. 2 is a cross-sectional view of another embodiment of the invention.
Figure 3:
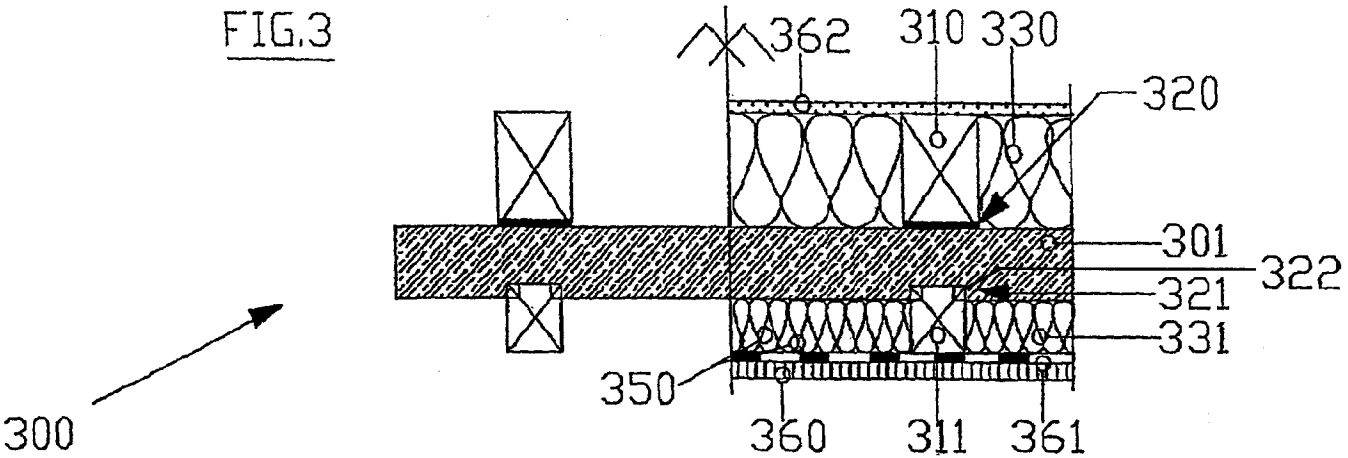
FIG. 3 is a cross-sectional view of another embodiment of the invention.

FIGS. 1 to 3 describe three preferred principles of execution of the inventive building parts. Here, in each case concrete cross sections (101, 201, 202, 301) in compound effect with wood cross sections (110, 210, 310, 311) are shown. As connection means between the concrete cross sections (101, 201, 202, 301) and the corresponding wood cross sections (110, 210, 310, 311) by way of example surface glueings (320), screw arrangements (221) glued-in formed metal parts (122) and geometrical indenting (321, 322) are shown.

FIG. 1 shows a component (100) with a concrete slab (101) and for example 2 wood cross sections (110) connected to one side. The composite or compound effect between wood and concrete is guaranteed for example by glued-in formed metal parts (122). Between the wood cross section (shown as rafters here) for example mineral insulation (130) in the form of rock wool (131) is inserted. A wood insulation board (111) is screwed onto the wood cross sections (110) with the wood insulation board providing a geometrical termination and representing for example the plaster base at the same time. Installations (140) for example in the form of electric cables (141) are inserted into the concrete slab (101).

FIG. 2 shows a component (200) with two concrete slabs (201, 202) and for example two internal wood cross sections (210). The compound or composite effect between wood and concrete is created for example on the top by screws (221) and on the bottom by nail plates (224). Between the wood cross sections (here shown as a girder) for example non-mineral insulation (230) in the form of cellulose particles (manufacturer: Isofloc) (231) is filled in. Installations (240) for example in the form of heating elements (241) are integrated into the lower concrete slab (202).

FIG. 3 shows a component (300) with a concrete slab (301) and for example two wood cross sections each (310, 311) arranged on both sides. The composite or compound effect between wood (310, 311) and concrete (301) is guaranteed at the top for example by surface glueing (320) and on the bottom for example by geometrical indenting (321) in the form of local wood cutouts (322). Between the wood cross sections (here shown as square timber) at the top plastic foams as PUR foam (330) are injected at the factory whereas at the bottom between the wood cross sections insulating boards 331) are placed on the construction site. In the lower insulation level (330) installations (350) in the form of water conduits and power lines are inserted. The internal space termination exists in that case by a gypsum plaster board (360) unilaterally adjacent to a vapor barrier (361). The external component termination is created here by a cement-bound chip board (36) acting simultaneously as a plaster base.

Figure 4:
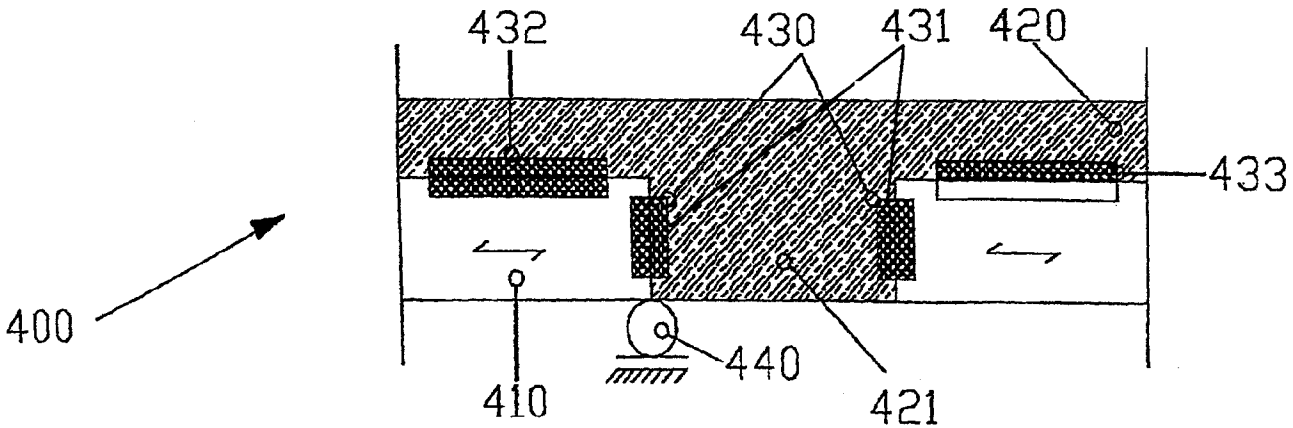
FIG. 4 is a cross-sectional view of another embodiment of the invention.

FIG. 4 shows by way of an example an inventive combined support situation (440) of a wood concrete composite component (400) where the loads are partly carried via the wood cross section (410) as well as the concrete cross section (420). The frontal load transmission (430) occurs here for example via at least one punched steel plate (431) slit and glued into the end-grained wood. The composite or compound effect is provided in that case via expanded metals (432, 433) slit-in and glued-in accordingly. If the support situation (440) is removed, another inventive embodiment is included in FIG. 4. In that case the partial reinforced concrete cross section (421) acts as a main beam of same ceiling for the wood concrete composite cross sections (410) connected on both sides via the frontal load transmission (430, 431).

Figure 5:
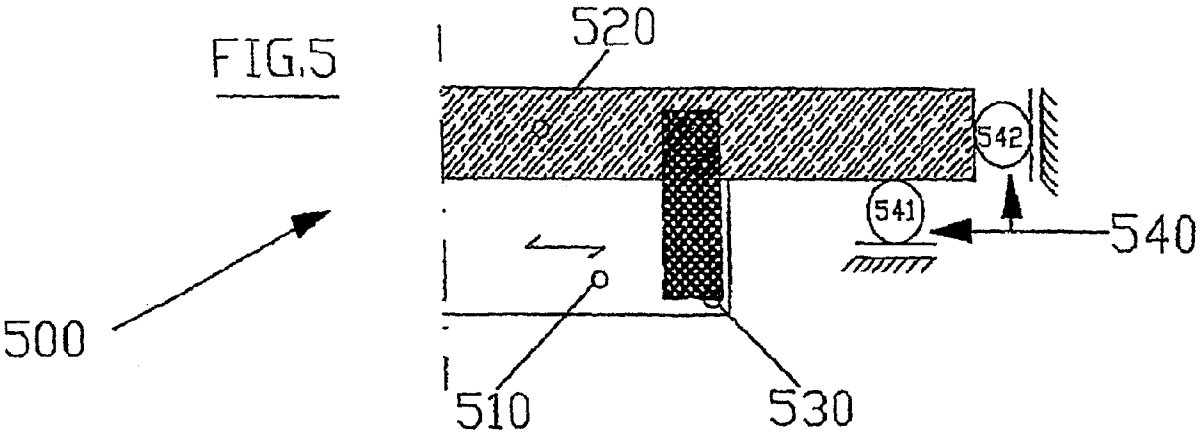
FIG. 5 is a cross-sectional view of another embodiment of the invention.

FIG. 5 shows a connection situation (540) where the load of the wood concrete composite component (500) is exclusively transmitted via the concrete cross section (520). The load transmission can be made optionally from the bottom (541), frontally (542) or in combination with what as been said above. A corresponding suspension (530) in the form of a nail plate (530) pressed and glued on both sides of the wood cross section permits in this example a force transmission from the wood cross section (510) into the concrete cross section (520).

Figure 6:
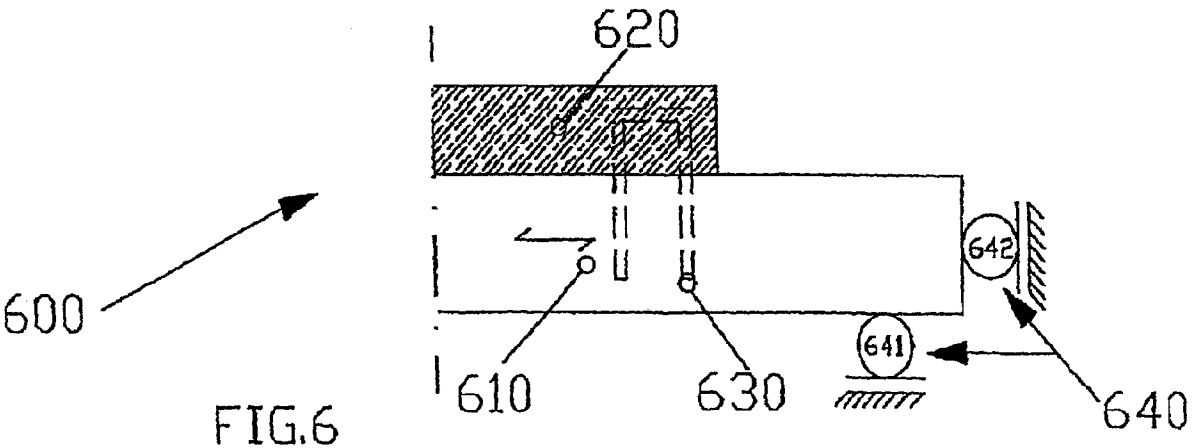
FIG. 6 is a cross-sectional view of another embodiment of the invention.

FIG. 6 shows a connection situation (640) where the load of the wood concrete composite component (600) occurs exclusively via the wood cross section (610). Load transmission can optionally occur at the bottom (641), frontally (642) or in combination with what has been said above. A corresponding force coupling (630) in the form of a reinforcement steel (630) glued-into the woods permits in this example at the end of the concrete cross section (620) a force transmission with the wood cross section (610).

Figure 7:
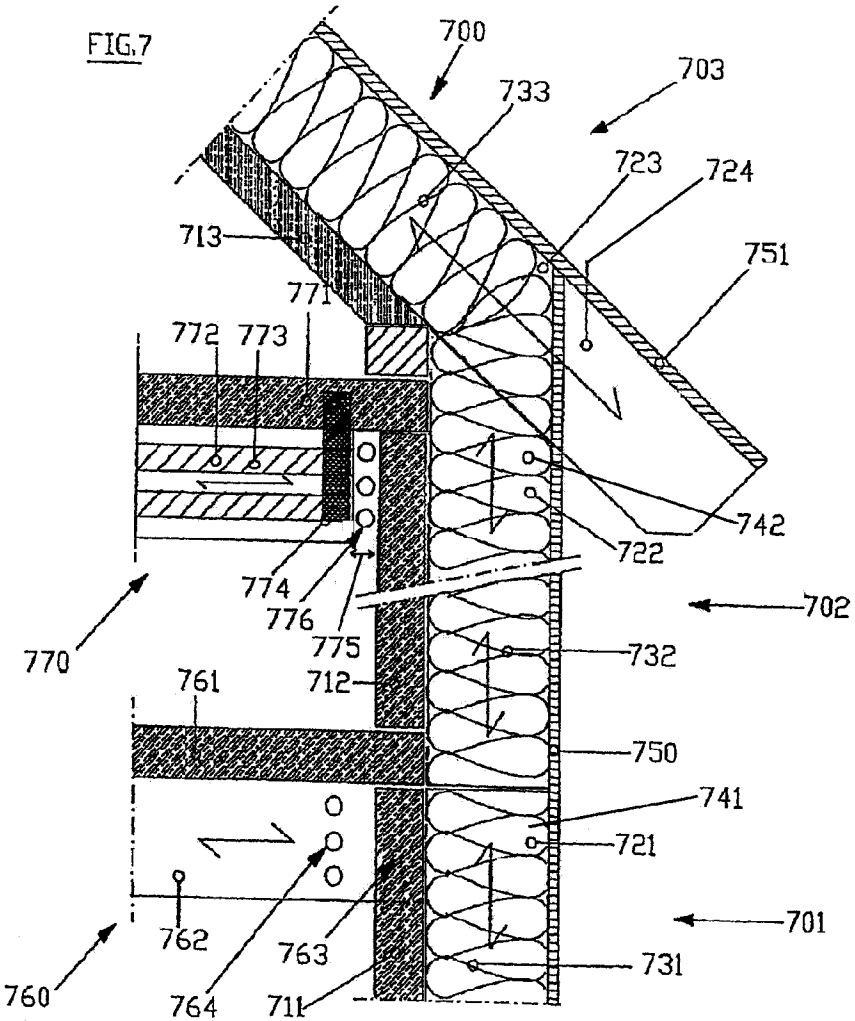
FIG. 7 is a cross-sectional view of another embodiment of the invention.

FIG. 7 shows the section of the envelope of a building (700) where all structural components are developed as prefabricated wood-concrete composite components (701, 702, 703, 760, 770). Here, in the walls (701, 702) and the roof (703) the concrete cross sections (711, 712, 713) are arranged as slabs and/or plates on the inside surface. The spaces of the external wood cross sections (721, 722, 723) are filled here on the construction site with non-mineral insulating material (731, 732, 733) and thus create a continuous, jointless insulating level. The wood cross sections in the walls (721, 722) have been selected here as trusses (741, 742) in order to avoid a thermal bridge within the wood cross sections (721, 722). The walls (701, 702) terminate with external wood insulation boards (759) which simultaneously serve as a plaster base. The wood cross sections (723) in the roof (703) are selected here as a rafter (724) in conventional form in order to provide increased bearing capacity of the roof (703) and to guarantee the appearance of a "normal roof". In the roof area (703) a wood panel (751) has been placed which is completed by counter-battens, battens and roof tiles (not shown here). The lower ceiling element (760) is composed of a top concrete slab (761) where here for example at the bottom wooden beam cross sections (762) are fixed in compound. Load transfer here occurs partly via the concrete cross section (761: concrete-to-concrete) and partly via the wood cross section (762: wood-to-concrete) via corresponding recesses (763) in the concrete slab (711) at the wall into which the wooden beam cross sections (762) extend. The openings (764) arranged in the wood cross section (762) permit the laying of installations. The upper ceiling element (770) is composed of a top concrete slab (771) where here for example at the bottom a wood plate cross section (772) in the form of cross-wise glued board layers (773) is fixed in compound (not shown). The load transfer occurs here exclusively via the concrete cross section (771: concrete-to-concrete). This is possible by formed steel parts (774) slit and glued into the wood (772) and anchored in the concrete (771). This suspension (771, 772, 774) described above only permits to have the wood cross section (772, 773) end at the distance to the wall (775) in order to permit an installation level (776) as a result. The entire development and completion of the interior (e.g. fair-faced concrete, wallpaper, ceiling heating, wall heating, ventilation, air conditioning system, floating floor, tiles, carpet . . . ) is made according to generally recognized rules of architecture and is not specified here.

Figure 8:
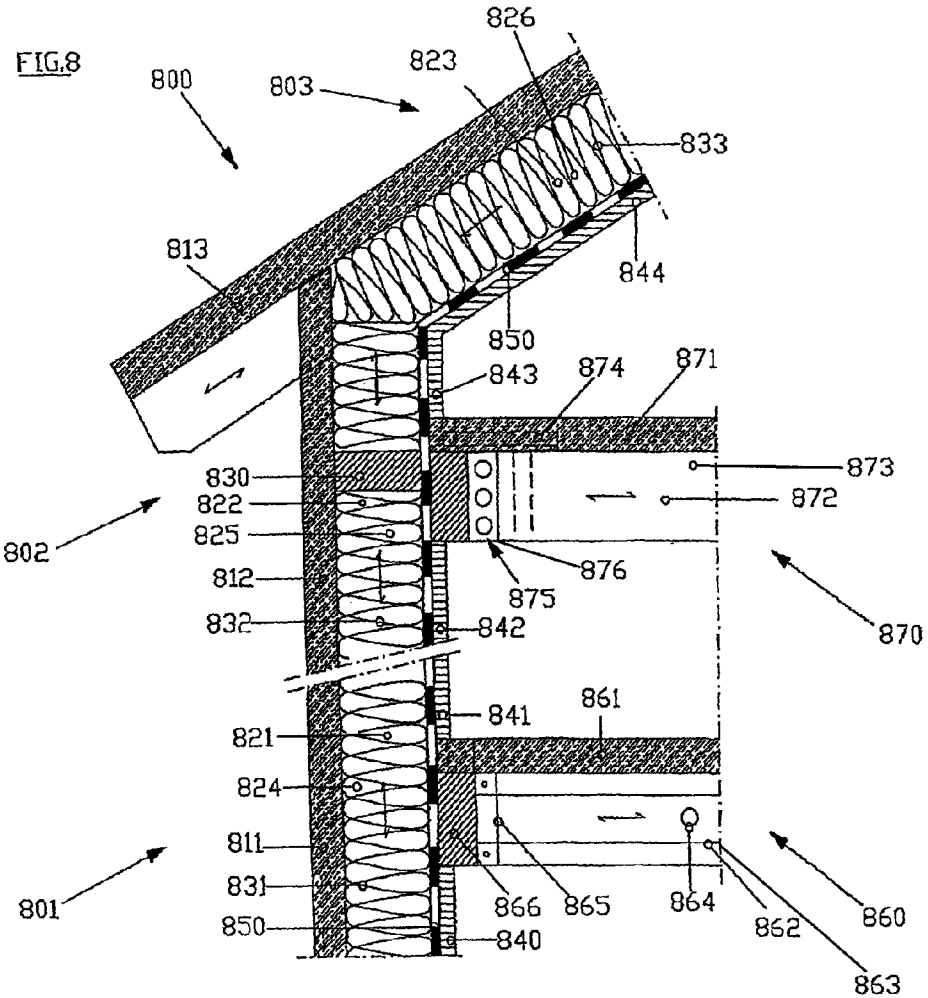
FIG. 8 is a cross-sectional view of another embodiment of the invention.

FIG. 8 shows the section of the envelope of another wood-concrete composite construction (800) where the walls (801, 802), the roof (803) and the lower ceiling (860) are supplied to the construction site as finished parts. The upper ceiling (870) was here concreted for example on the construction sit. Here in the walls (801, 802) and the roof (803) the concrete cross sections (811, 812, 813) are arranged as slabs on the exterior. The external wall can for example be configured as fair-faced concrete or be terminated by a corresponding painting and/or on surface with painting. The spaces of the interior wood cross sections (821, 822, 823) and those at location 823 are here not filled with mineral insulating materials (831, 832, 833) on the construction site and thus create a continuous insulating level. The wood cross sections (821, 822) in the walls (801, 802) are here selected as I-beams (824, 825) in order to avoid a thermal bridge within the respective wood cross sections (821, 822; keyword: passive energy house). The wood cross sections (823) in the roof (803) are selected here as a plank (826) in order to provide increased bearing capacity of the roof (803). The plank rafters (826) penetrate the concrete plate (812) of the external wall and thus provide a conventional appearance. Between the vertically extending wood cross sections (821, 822) of the external walls (801, 802), if necessary, also further—for example horizontally extending—wood cross sections (830) can be introduced in compound in order to cover load peaks, if necessary. The internal surface of the external walls (801, 802) and the roof (803) terminate with a vapor barrier (850: here the joints must be tightly closed in individual parts) and cement bound wood chip boards (840, 841, 842, 843, 844) which at the same time serve as wallpaper base. The roofing occurs here via bituminous roof sealings (not shown).

The lower ceiling element (860) is composed of a top concrete slab (861) to which here for example wood cross sections (862) are fixed at the bottom as I-beams (863) in compound (not shown). Load transfer occurs here partly via the concrete cross section (861: concrete-to-wood) and partly via the wood cross section (862: wood-to-wood) via a joist hanger (865) into the end girder (831) extending on the wall. The opening (864) arranged in the wood cross section (862) permits the laying of installations.

The upper ceiling element (870) is composed of a top finished concrete slab (871) which here for example by subsequent casting of concrete into corresponding openings/recesses at the factory and/or on the construction site is connected in a thrust-proof manner with the bottom wood plate cross section (872) in the form of board stacks (873) (for example by glued-in formed plastic parts: not shown here). The load transfer occurs here solely via the concrete cross section (871: concrete-to-wood). This is possible by formed steel parts (874: as a T-profile) screwed into the wood and anchored in concrete. The suspension described above (875) permits also to have the wood cross section (872) end at a distance (875) to the wall in order to permit an installation channel located approximately at 876 in this way. The entire development and completion of the interior (e.g. fair-faced concrete, wallpaper, ceiling heating, wall heating, ventilation, air conditioning system, floating floor, tiles, carpet . . . ) is made according to generally recognized rules of architecture and is not specified here.

Figure 9:
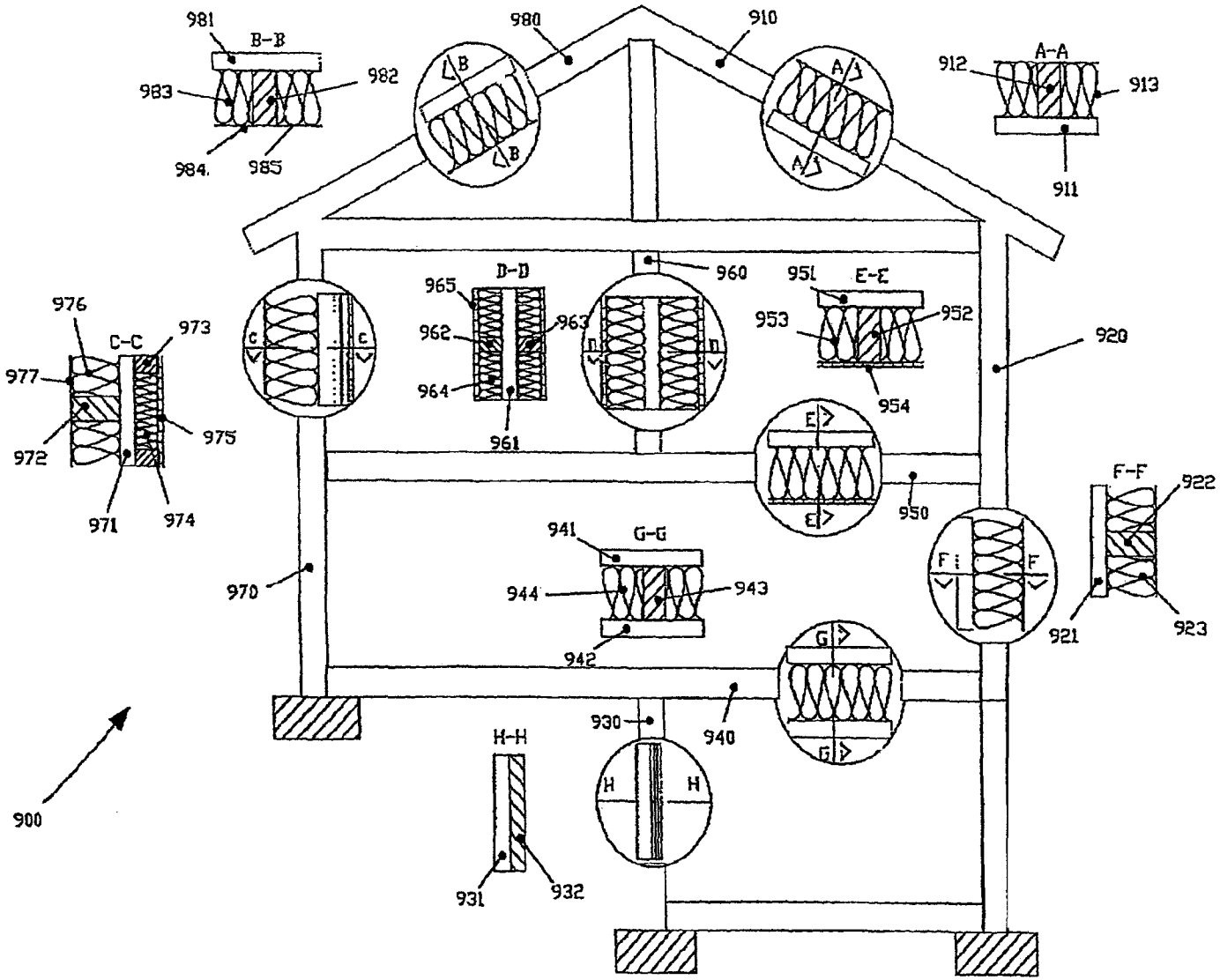
FIG. 9 is a cross-sectional view of another embodiment of the invention.

FIG. 9 shows for example a construction where the major constructive elements have been made in wood-concrete composite construction. The roof element (910) as well as the wall element (920) are shown here as an internal concrete slab (911, 921) with non-positive connection with the external wooden beams (912, 922). Between the individual wood cross sections (912, 922) corresponding insulations (913, 923) are inserted. Surprisingly it has turned out that the roof element (910) can also be excellently used as a ceiling element (not shown here). In that case the internal concrete slab (911) would preferably have to be executed in fair-faced concrete quality and equipped with a correspondingly higher tensile reinforcement (not shown here). Moreover, in the insulating layer (913) between the wood cross sections (912) various installations such as for example power lines, water conduits sanitary lines and/or air ducts (not shown here) could be laid. The other development stages such as for example floating floor, tiles, carpet correspond to the State of the Art and are not explained further.

The wall element (930) in the area touching the ground is shown here as an external concrete slab (931) with non-positive connection with the internal wood plates (932). Thus, in contact with the ground a corresponding construction sealing (not shown here) can be realized on the concrete slab (931). In another version not shown here the concrete has been executed as a waterproof concrete so that a construction sealing would not become necessary.

The lowermost ceiling and/or further on also the bottom plate (940) is executed as a double shell finished wood-concrete composite art. It is composed of two concrete slabs (941, 942) which are in compound or composite effect by intermediate wood cross sections (943) (cf. for example FIG. 2). The wood cross sections (943) are here preferably execute as truss girders and/or triangular girders (technical terms from wood construction; not shown here) in order to provide at high bearing capacity at the same time a high heat insulation (keyword: reduction of thermal bridge within the wood cross section—passive energy house). Between the individual wood cross sections (943) as well as in the openings of the truss girders and/or triangular girders a mineral insulation (944) is inserted.

The ceiling (950) located above has been made here for example in cast-in-place concrete method with a top concrete slab (951) and wood ribs (952) extending below in wood-concrete composite construction. For span reduction a reinforced concrete main beam (955) of same ceiling is executed in connection with the laterally connected wood ribs (for example 952) (cf. for example FIG. 4). The wood ribs (952) out of gluelam and the concrete cross sections (951, 955) are made in fair-faced quality. Further design of this ceiling occurs in a far later development stage where insulation (953) is arranged between the individual wood cross sections (952). As ceiling cladding a three-ply (954) has been selected here which was screwed onto the wood cross sections (952) in fair-faced quality.

The ascending wall section and/or pillar cross section (960) is shown as single shell concrete cross section (961) with square timber (962, 963) out of coniferous wood arranged on both sides with compound effect. In this exemplary embodiment the square timber (962, 963) is arranged opposed to each other. Thus, stabilization of the intermediate concrete cross section (961) can surprisingly be increased and thus bearing capacity can be improved. Between the square timber (962, 963) on each wall side an insulation (964) exists with subsequent gypsum plaster planking (965) as wallpaper base. Not shown are the installations in the respective insulation levels (964). The pillar-like wall section (960) serves here as an element reducing the bearing distance for the wooden beam ceiling of the attics located above.

The left external wall (970) is shown as a single shell concrete slab and/or plate (971) with square timber (972, 973) out of coniferous wood arranged on both sides in compound effect. In this exemplary embodiment, the square timber (972 and 973) opposed to each other are arranged offset to each other. Thus, the thermal insulation property of the overall structure can be surprisingly increased (no continuous thermal bridge due to square timber opposed to each other exists; keyword: passive energy house) and safety against buckling of the concrete slab (971) can be improved. Between the square timber (972), an insulation (976) exists on the external wall surface (970) with subsequent cement bound chip board (977) as a plaster base. On the inside surface, insulating boards (974) are placed between the square timber (973) with subsequent gypsum plaster board (975) as a wallpaper base. Not shown are various installations (for example power lines, water conduits) in the internal insulating level (974).

The left roof element (980) is shown here as an external concrete slab (981) with internal wood cross section (982) as a wood-concrete composite element. Between the individual wood cross sections (982), corresponding insulating layers (983) are inserted. The internal roof termination provides a vapor barrier (984) which has been inserted between wood cross section (982) and planking (985).

Figure 10:
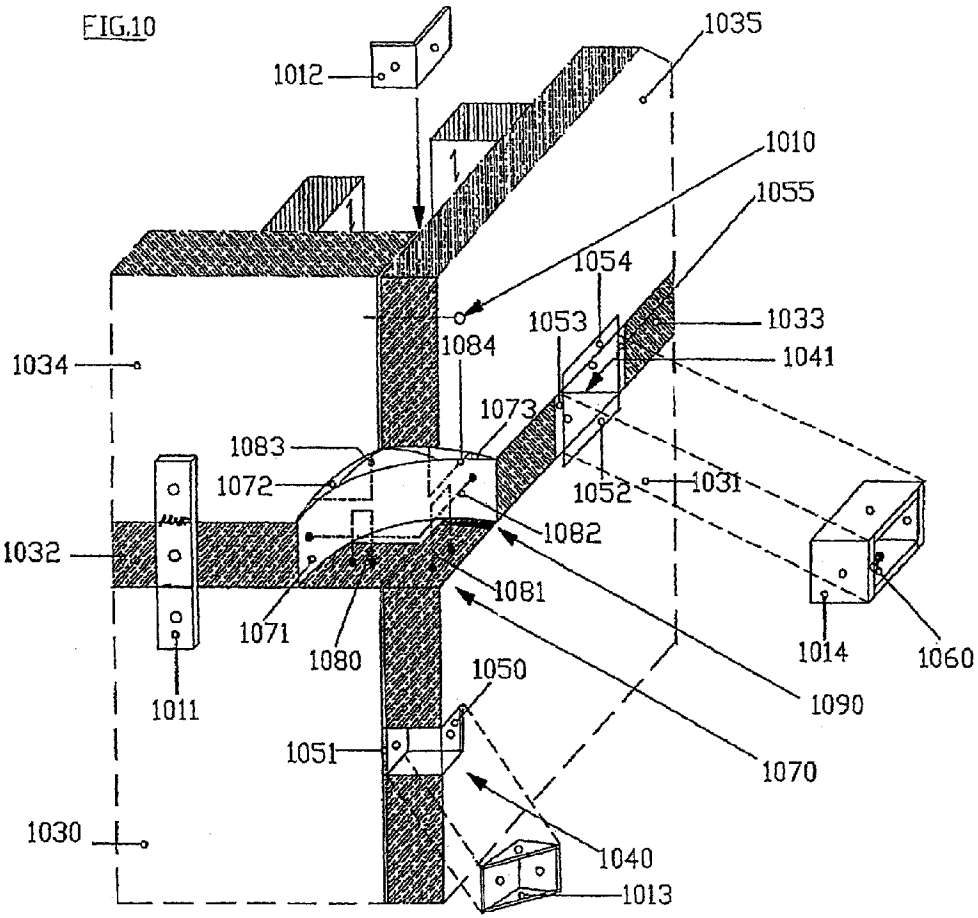
FIG. 10 is a perspective cut away view of another embodiment of the invention.

FIG. 10 shows by way of an example some connection elements which are preferably used for an application of the inventive subject matter. By corresponding concrete anchors (1010) in the form of shear connectors and/or expansion anchors two individual elements can be connected to each other by a non-positive connection.

By placed on and screwed flats (1011) at least two or more individual elements (here: 1030, 1032, 1034) can be connected to each other by a non-positive connection in intersections or system centers. Moreover, laced on angle irons (1012) in connection with corresponding resin-bedded roof bolts (not shown) are likewise suitable for high load transmissions. By prefabricated formed steel parts (1013, 1014) inserted into corresponding recesses (1040, 1041) and with corresponding anchor plates (1050, 1051, 1052, 1053, 1054, 1055) inserted into the concrete cross sections considerable loads can be selectively transmitted. Force transmission between the formed steel parts (1013, 1014) and the anchor plates (1050, 1051, 1052, 1053, 1054, 1055) preferably takes place by screwing, glueing and/or welding. Force transmission from the anchor plates (1050, 1051, 1052, 1053, 1054, 1055) into the respective reinforced concrete parts (1030, 1031, 1032, 1033, 1035) takes place via reinforcing steels set in concrete which are coupled with the anchor plates (1050, 1051, 1052, 1053, 1054, 1055) by a non-positive connection.

The formed steel part (1013) serves for example for coupling of two wall elements (1030, 1031). For this purpose, the connection means as formed steel part (1013) was fixed already at the factory to the wall element (1031) so that on the construction site only screwing and/or welding with the anchor plate (1051) of the wall element (1030) was necessary. The formed steel part (1013) was configured such that it serves also as a lifting point for the wall element (1031).

The formed steel part (1014) serves by way of an example for coupling of two wall elements (1031, 1035) with two ceiling elements (1032, 1033). For this purpose, the formed steel part (1014) had already been connected to the ceiling element (1032) at the factory so that on the construction site only screwing with the other ceiling element (1033) and the two wall elements (1031, 1035) became necessary. The formed steel part (1014) was configured such that it serves also as a lifting point for the ceiling element (1032). Moreover, the formed steel part (1014) has four bores in order to provide a screwing with the anchor plates (1052, 1053, 1054, 1055). Another application consists in welding the formed steel part (1014) with the adjacent anchor plates (1052, 1053, 1054, 1055).

Another exemplary joining technique consists in casting of casting pockets (1070) in the individual concrete cross sections on the construction site. FIG. 10 shows by way of an example how five concrete cross sections (1030, 1031, 1032, 1034, 1035) can be connected to each other by non-positive and positive connection by corresponding recesses (1071, 1072, 1073) with subsequent casting. For this purpose, reinforcing irons (1080, 1081, 1082, 1083, 1084) protrude from the individual concrete cross sections (1030, 1031, 1032, 1034, 1035), which on the construction site are coupled to each other by corresponding reinforcing bonds (not shown) and are cast with a corresponding concrete mixture setting rapidly.

Another joining technique consists in surface glueing (1090) of at least one compound surface between the wood cross sections and/or concrete cross sections among each other and/or with each other. An exemplary embodiment of this joining technique consists in surface glueing and/or mortar bed (1090) of the concrete cross sections (1031, 1032, 1033) with each other.

Another form of connection consists in the coupling of wood components. Here, any embodiments of the relevant standards as well as the corresponding State of the Art are possible.

Moreover, it is also possible to replace the concrete cross section (1930) by a wood cross section in the form of a wood panel (1030'). In that case it would be possible to screw the formed steel part (1013) directly to the wood panel (1030'). But it would also be imaginable to connect the anchor plate (1051) by a non-positive connection by screwing and/or glueing with the wood cross section (1030') thus permitting a conventional screwing of the formed steel part (1013) with the anchor plate (1051). Moreover, it that case it would be possible to glue the reinforcing iron (1080) into the wood panel (1030'). By this the wood cross section (1030') with the casting of the casting pocket (1070) could be connected by a positive and non-positive connection with the concrete cross sections (1031, 1032, 1034, 1035).

Figure 11:
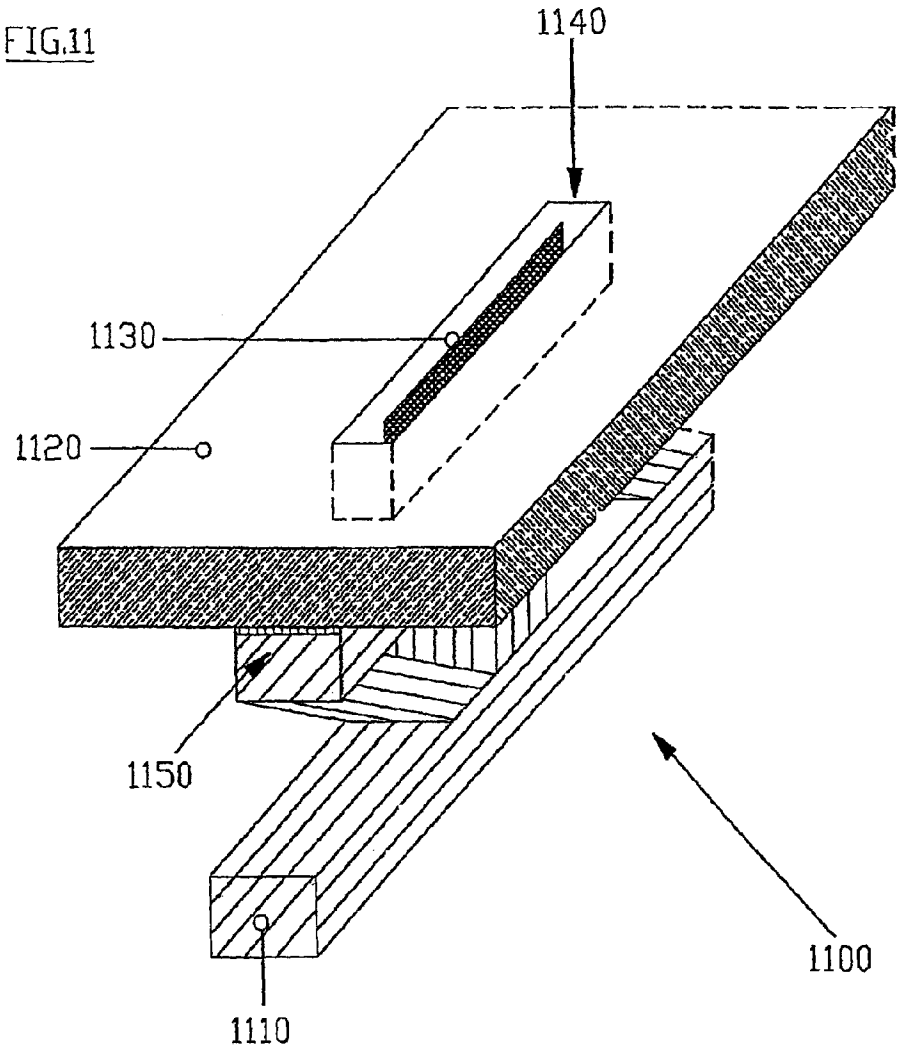
FIG. 11 is a perspective cut away view of another embodiment of the invention.

FIG. 11 shows by way of an example an individual component composed of a prefabricated wood cross section (1110), for example as a triangular binder, and a prefabricated concrete cross section (1120). The prefabricated concrete cross section (1120) has at least one opening (1140) permitting a compound or composite effect with the wood cross section (1110). In the wood cross section (1110) at least one connection means (1130) is fixed by glueing technique protruding into the opening (1140) of the prefabricated concrete cross section. The casting of the opening (1140) at any time at the factory, during transport and/or on the construction site then creates the desired compound or composite effect between the wood cross section (1110) and the concrete cross section (1120). Surprisingly it has turned out that by another possible surface glueing (1150) of at least a contact surface of the wood cross sections (1110) and the concrete cross sections (1120) a considerable load increase can be achieved. In another embodiment of the invention (not shown here) it is provided that the above mentioned connection alternatives (1130, 1150) are executed as an individual approach. The intermediate wood-concrete composite element can for example be used as a bridge, ceiling, wall, pillar, roof, girder.

The invention comprises in particular also the contents of the following paragraphs:

Constructions made of individual components with the individual components being at least partially composed of prefabricated wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) which are optionally provided with further insulating, protecting and/or cladding materials.

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to the preceding paragraph with the individual components being at least partly composed of prefabricated wood components (773, 952), concrete components (871) and/or finished wood-concrete composite elements (870, 1030, 1030', 1031, 1032, 1034, 1035) which are then completed with concrete cast at the factory or later on the construction site.

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to the preceding paragraph with the individual component being at least partly composed of prefabricated wood components (773, 873, 952, 1110) and prefabricated concrete components (871, 1120), which are joined or assembled already at the factory or on the construction site and connected by a non-positive connection by surface glueing (1150) and/or concrete cast.

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to the preceding paragraph with the individual components being at least partly composed of prefabricated wood components (773, 873, 952, 1110) and prefabricated concrete components (871, 1120), which are joined or assembled at the factory into wood-concrete composite elements and are connected by a non-positive connection and are only then delivered to the construction site.

Constructions made of wood-concrete composite elements (100, 910, 920, 980) according to one or several of the preceding paragraphs with the individual components being composed of at least one wood component (110, 912, 922, 982) and at least one concrete component (101, 911, 921, 981) which have at least one surface being connected with each other by a non-positive connection. Constructions made of wood-concrete composite elements (300, 960, 970) according to one or several of the preceding paragraphs with the individual components being composed of at least two wood components (310, 311, 962, 963, 972, 973, 974) and an intermediate concrete component (301, 961, 971) with at least one surface connected by a non-positive connection existing between the wood component (310, 311, 962, 963, 972, 973, 974) and the concrete component (301, 961, 971).

Constructions made of wood-concrete composite elements (200, 940) according to one or several of the preceding paragraphs with the individual components being composed of a wood component (210, 943) and at least two concrete components (201, 202, 941, 942) with at least one surface connected by a non-positive connection existing between the wood component (210, 943) and the concrete component (201, 202, 941, 942).

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to one or several of the preceding paragraphs with it being possible to insert insulations (130, 230, 330, 331, 731, 732, 733, 831, 832, 833) and/or installations (350) between the wood cross sections (110, 210, 310, 311, 410, 510, 610, 721, 722, 723, 821, 822, 823, 912, 922, 943, 952, 962, 963, 972, 973, 982) at the factory and/or on the construction site.

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to one or several of the preceding paragraphs with the connections and/or couplings (641, 642) of the individual components among each other and/or with other components existing only via the wood cross section (610).

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to one or several of the preceding paragraphs with the connections and/or couplings (541, 542, 774, 874) of the individual components among each other and/or with other components existing only via the concrete cross section (520, 771, 871).

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to one or several of the preceding paragraphs with the connections and/or couplings (440, 761, 763, 865) of the individual components among each other and/or with other components existing partly via the wood cross section (410, 762, 831, 862) and/or partly by the concrete cross section (421, 761, 861).

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to one or several of the preceding paragraphs with the connections of the individual components among each other and/or with other components being created with by positive geometrical connection (763), by mechanical connection means (865, 1010), by surface glueing (1090, 1150), by glued joints (1010, 1080), by welded connections (1013, 1051) and/or by concrete cast (1070).

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1030, 1100) according to one or several of the preceding paragraphs with the compound or composite effect of the concrete cross sections (101, 201, 202, 301, 420,421, 520, 620, 711, 712, 713, 761, 771, 811, 812, 813, 861, 871, 911, 921, 931, 941, 942, 951, 961, 971, 981, 1120) and of the wood cross sections (110, 210, 310, 311, 410, 510, 610, 721, 722, 723, 762, 772, 821, 822, 823, 862, 872, 912, 922, 932, 943, 952, 962, 963, 972, 973, 982, 1110) with each other being created by positive geometrical connection (321, 763, 1140), by mechanical connection means (221, 224, 530, 874), by surface glueing (320, 1150), by glued joints (122, 430, 431, 433, 530, 630, 774, 1080, 1130) and/or by concrete cast (1070, 1140).

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to one or several of the preceding paragraphs with these being used by way of an example in residential houses, commercial buildings, industrial buildings, sports facilities, factories, parking garages, stadiums, towers, bridges as creative components and/or components with carrying capacity.

Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to one or several of the preceding paragraphs with the wood components (110, 210, 310, 311, 410, 510, 610, 721, 722, 723, 762, 772, 821, 912, 922, 932, 943, 952, 962, 963, 972, 973, 982, 1110) being created as single-piece cross sections such as for example girders, rafters, binders, slabs, plates, planks and/or multi-piece cross sections such as for example truss girders, triangular girders, I-beams, T-beams, box beams, web plates. Constructions made of wood-concrete composite elements (100, 200, 300, 400, 500, 600, 701, 702, 703, 760, 770, 801, 802, 803, 860, 870, 910, 930, 940, 950, 960, 970, 980, 1030, 1031, 1032, 1033, 1034, 1035, 1100) according to one or several of the preceding paragraphs with the concrete components (101, 201, 202, 301, 420, 421, 520, 620, 711, 712, 713, 761, 771, 811, 812, 813, 861, 871, 911, 921, 931, 941, 942, 951, 961, 971, 981, 1120) being created as single-piece cross sections such as for example girders, pillars, slabs, plates and/or multi-piece cross sections such as for example TT-beams, I-beams, T-beams, box beams, web plates, π-plates.

The invention claimed is:

1. A substantially flat and elongated construction assembly having extreme peripheral edges, the assembly made of individual components, comprising: wood-concrete composite elements made up of at least one wood component with a wood cross section and a concrete component with a concrete cross section with connections and/or couplings of the individual components being made between each other and/or with other components, in which the construction assembly is designed to interact with an adjacent support structure via a connection by which the construction assembly interacts with at least one degree of freedom of movement at the peripheral edges only by the concrete component with the adjacent support structure, and in which the concrete component alone is in contact with the adjacent support structure via the connection.

2. The construction assembly according to claim 1, wherein the connections of the individual components are created by a connection selected from one of a group of connections consisting of a positive geometrical connection, a mechanical connection, a surface gluing connection, a glued joint connection, a welded connection and a concrete cast connection.

3. The construction assembly according to claim 1, wherein the concrete cross sections and wood cross sections connect with each other for formation of wood-concrete composite elements by means of a positive geometrical connection, a mechanical connection means, a surface gluing connection, a glued joint connection and/or by a concrete cast connection.

4. The construction assembly according to claim 1, wherein the wood-concrete composite elements are composed of at least one wood component and at least one concrete component which have at least one surface connected by a non-positive connection.

5. The construction assembly according to claim 1, wherein the wood-concrete composite elements are composed of at least two wood components and in which an intermediate concrete component with at least one surface is connected by a non-positive connection existing between the wood components and the concrete component.

6. The construction assembly according to claim 1, wherein the wood-concrete composite elements are composed of a wood component and at least two concrete components with at least one surface connected by a non-positive connection between the wood component and the concrete component.

7. The construction assembly according to claim 1, wherein the wood-concrete composite elements are provided with insulating, protecting and/or cladding materials.

8. The construction assembly according to claim 1, further comprising insulation and/or installations between the wood cross sections, wherein the insulations and/or the installations between the wood cross sections are optionally inserted at a factory and/or on a construction site.

9. The construction assembly according to claim 1, wherein the construction assembly is used in a construction project selected from a group of construction projects consisting of a residential house project, a commercial building project, an industrial building project, a sports facility project, a factory project, a parking garage project, a stadium project, a tower project, a bridge as a creative component project, and a bridge with carrying capacity project.

10. The construction assembly according to claim 1, wherein the wood components are created as single-piece cross sections.

11. The construction assembly according to claim 1, wherein the concrete components are created as single-piece cross sections.

12. A method of construction comprising: utilizing the construction assembly of claim 1 in a construction project; and, assembling the wood-concrete composite elements together at a factory or later at a construction site with connections and/or couplings of the individual components and/or with other components with a non-positive connection and/or a positive connection and/or a material connection.

13. The construction assembly according to claim 1, in which the construction assembly interacts with the adjacent support structure, with two degrees of freedom of movement, at the peripheral edges only by the one concrete component.

14. The method of construction of claim 12 in which the construction assembly interacts with the adjacent support structure, with two degrees of freedom of movement, at the peripheral edges only by the one concrete.

15. The method of construction of claim 12, wherein the connections of the individual components are created by a connection selected from one of a group of connections consisting of a positive geometrical connection, a mechanical connection, a surface gluing connection, a glued joint connection, a welded connection and a concrete cast connection.

16. The method of construction of claim 12, wherein the concrete cross sections and wood cross sections connect with each other for formation of a wood-concrete composite elements by means of a positive geometrical connection, a mechanical connection means, a surface gluing connection, a glued joint connection and/or a concrete cast connection.

17. The method of construction of claim 12, wherein the wood-concrete composite elements are composed of at least one wood component and at least one concrete component which have at least one surface connected by a non-positive connection.

18. The method of construction of claim 12, wherein the wood-concrete composite elements are composed of at least two wood components and in which an intermediate concrete component with at least one surface is connected by a non-positive connection existing between the wood components and the concrete component.

19. The method of construction of claim 12, wherein the wood-concrete composite elements are composed of a wood component and at least two concrete components with at least one surface connected by a non-positive connection between the wood component and the concrete component.

20. The method of construction of claim 12, wherein the construction assembly is used in a construction project selected from a group of construction projects consisting of a residential house project, a commercial building project, an industrial building project, a sports facility project, a factory project, a parking garage project, a stadium project, a tower project, a bridge as a creative component project, and a bridge with carrying capacity project.

* * * * *

UNITED STATES PATENT AND TRADEMARK OFFICE

CERTIFICATE OF CORRECTION

PATENT NO. : 8,590,239 B2
APPLICATION NO. : 12/160622
DATED : November 26, 2013
INVENTOR(S) : Tobias Bathon It is certified that error appears in the above-identified patent and that said Letters Patent is hereby corrected as shown below:

In the Claims

In Col. 15, line 13, replace the phrase "each other for formation of a wood-concrete" with --each other for formation of wood-concrete--

Signed and Sealed this
Twenty-seventh Day of May, 2014

Michelle K. Lee

Michelle K. Lee
*Deputy Director of the United States Patent and Trademark Office*